US007607551B2

(12) United States Patent
Coughlin et al.

(10) Patent No.: US 7,607,551 B2
(45) Date of Patent: Oct. 27, 2009

(54) TINT PLUG FOR PAINT CONTAINER

(75) Inventors: Timothy J. Coughlin, Holly, MI (US); John Robert Selina, Brighton, MI (US)

(73) Assignee: Letica Corporation, Rochester, MI (US)

( * ) Notice: Subject to any disclaimer, the term of this patent is extended or adjusted under 35 U.S.C. 154(b) by 290 days.

(21) Appl. No.: 11/607,712

(22) Filed: Dec. 1, 2006

(65) Prior Publication Data

US 2008/0128443 A1 Jun. 5, 2008

(51) Int. Cl.
*B65D 51/18* (2006.01)
*B65D 39/00* (2006.01)

(52) U.S. Cl. ..... 220/254.7; 220/791

(58) Field of Classification Search ..... 220/254.1, 220/254.7, 790, 791, 793
See application file for complete search history.

(56) References Cited

U.S. PATENT DOCUMENTS

| | | | | |
|---|---|---|---|---|
| 3,719,304 A * | 3/1973 | Douglas | ..... | 220/260 |
| 4,840,289 A * | 6/1989 | Fait et al. | ..... | 220/270 |
| 5,660,302 A | 8/1997 | Trout | ..... | 220/790 |
| 5,799,813 A | 9/1998 | Letica | ..... | 220/254 |

* cited by examiner

*Primary Examiner*—Harry A Grosso
(74) *Attorney, Agent, or Firm*—Young Basile

(57) ABSTRACT

A plastic paint can having a closure with a circular aperture which releasably receives an all plastic tint plug having a circular pull ring. The tint plug is made locally more deformable to provide a progressive release by means of a well of thin material formed within the recessed center deck of the tint plug adjacent the rim structure and a pair of symmetrically arranged slots opening externally of the rim structure surface.

8 Claims, 3 Drawing Sheets

TINT PLUG FOR PAINT CONTAINER

FIELD OF THE INVENTION

This invention relates to paint containers and more particularly to an improved tint plug for use in combination with closures for containers to provide a progressive release of the tint plug from the closure.

BACKGROUND OF THE INVENTION

Containers comprising the combination of a can and a closure are commonly used for paint and similar products. It is advantageous to use a tint plug in the closure deck so that coloring agents may be added to a base color paint by the retailer without the necessity of removing the closure from the container and compromising the primary seal. A well known commercially available tint plug is described in U.S. Pat. No. 5,660,302. It comprises a combination of a circular plug having a recessed deck and an integral pull ring disposed within the recess. To release the tint plug from the closure, the user grasps the pull ring and pulls it firmly up and away from the closure.

A problem associated with prior art tint plugs is the relatively abrupt manner in which the tint plug is released from the closure when sufficient force is applied. This not only makes the tint plug difficult to release from the closure, but creates additional problems when wet paint is adhered to the inner surface of the tint plug and the abrupt release of the tint plug from the closure tends to spatter the adhered paint over objects and/or persons in the immediate area of the paint container.

SUMMARY OF THE INVENTION

The present invention provides an improved tint plug for use in combination with paint can closures and the like wherein the release of the plug from the closure is progressive rather than abrupt and, therefore, tends to mitigate the problems associated with the prior art tint plugs as described above.

In general, the tint plug of the present invention is a unitary plastic article defining an annular rim structure and a depressed circular deck, the rim structure having an external peripheral groove which fits tightly within an aperture in the paint can closure to provide a fluidtight and airtight seal. A well is formed in a portion of the tint plug deck immediately adjacent an interior portion of the rim structure. A circular pull ring which fits within the depressed circular recess of the tint plug incorporates a stem which is integrally attached to the well immediately adjacent the inner surface of the rim structure such that pulling on the ring deforms the tint plug rim inwardly primarily in the area of the well. Attaching the stem to the well lowers the pull point and causes easier and earlier separation of the rim structure from the closure opening. This tends to produce a progressive release of the tint plug which allows it to "peel away" from the closure rather than the more abrupt release associated with prior art devices.

In the preferred embodiment illustrated herein, the localized deformability of the tint plug is further enhanced by the inclusion of slots in the exterior surface of the rim structure below the peripheral groove and in the immediate area of the well. In the preferred form, a pair of slots are formed in the exterior rim structure in opposed symmetrical relationship to the area where the stem of the pull ring is attached to the well. The slots extend only about 45°-55° around the circumference of the tint plug thereby localizing the enhanced deformability of the tint plug to the area of the plug which is separated from the closure when the user pulls on the pull ring.

The various additional features and advantages of the invention will be best understood from a reading of the following specification which describes a preferred and illustrative embodiment.

DETAILED DESCRIPTION OF THE ILLUSTRATIVE EMBODIMENT

Figure 1:
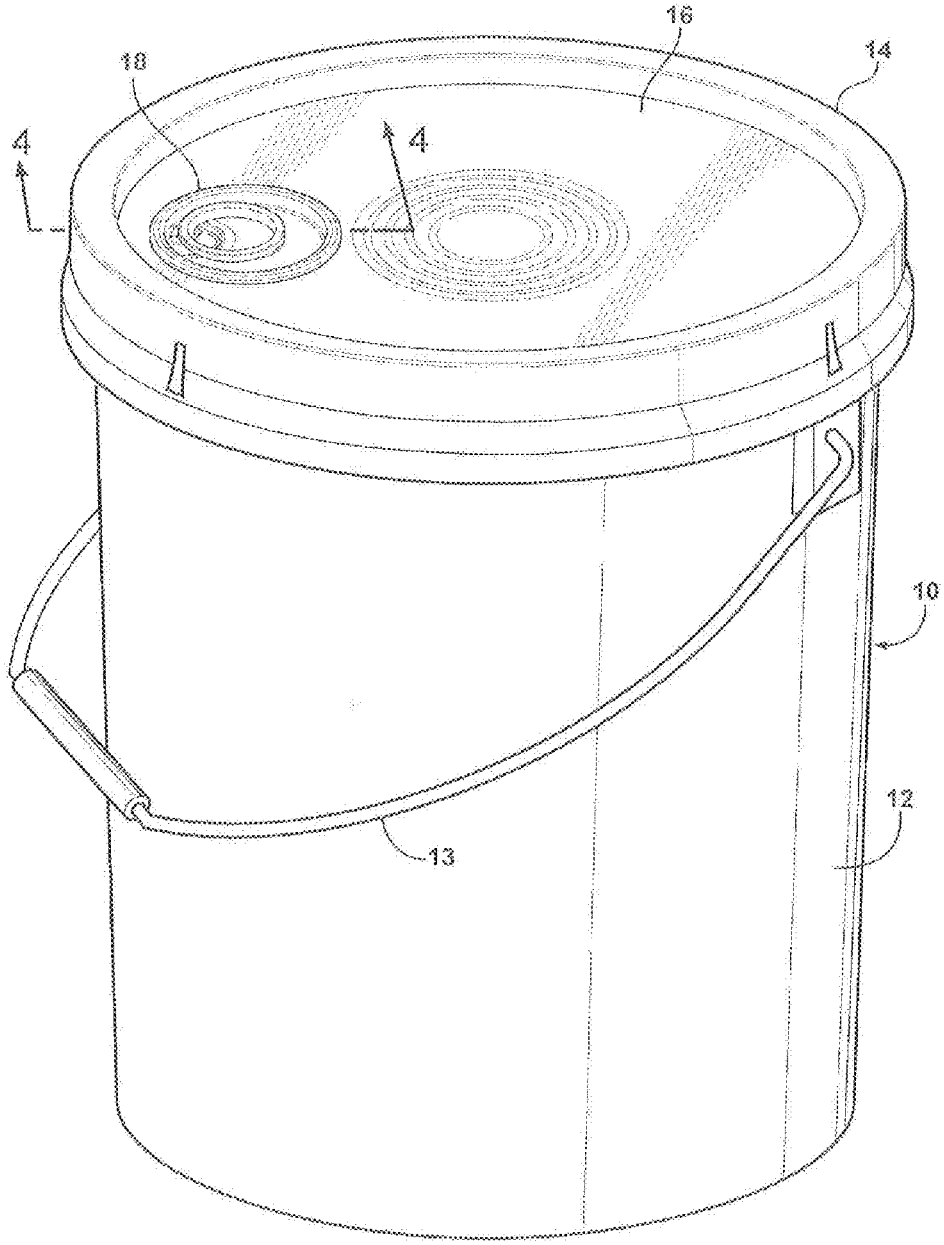
FIG. 1 is a perspective view of a cylindrical all plastic paint container comprising a cylindrical can and a snap on closure wherein a tint plug constructed in accordance with the present invention is installed in the closure.
Figure 2:
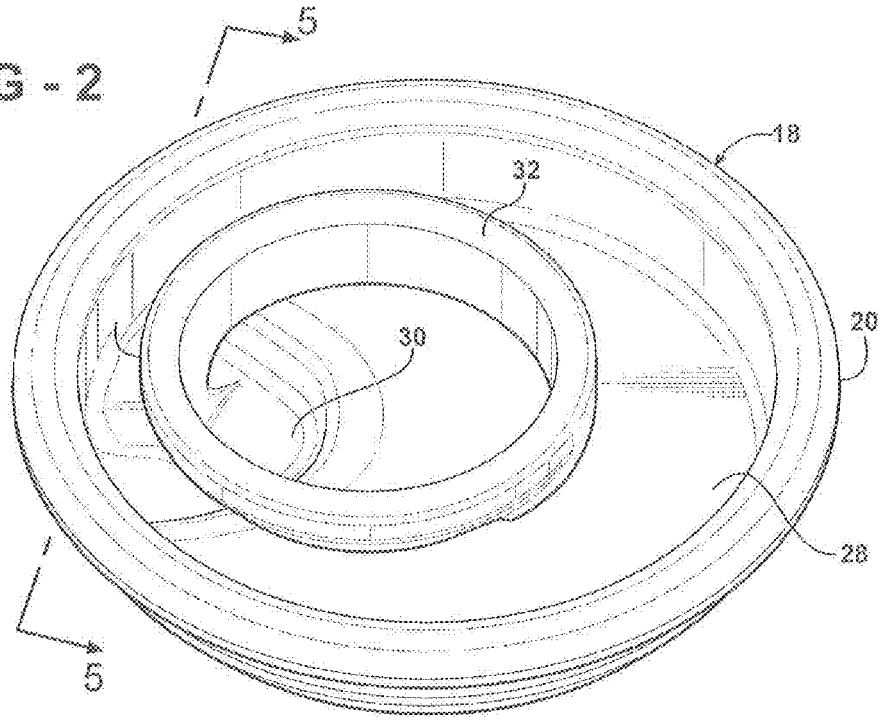
FIG. 2 is a perspective view of the tint plug of FIG. 1 from a top view position showing the pull ring within the tint plug recess.
Figure 3:
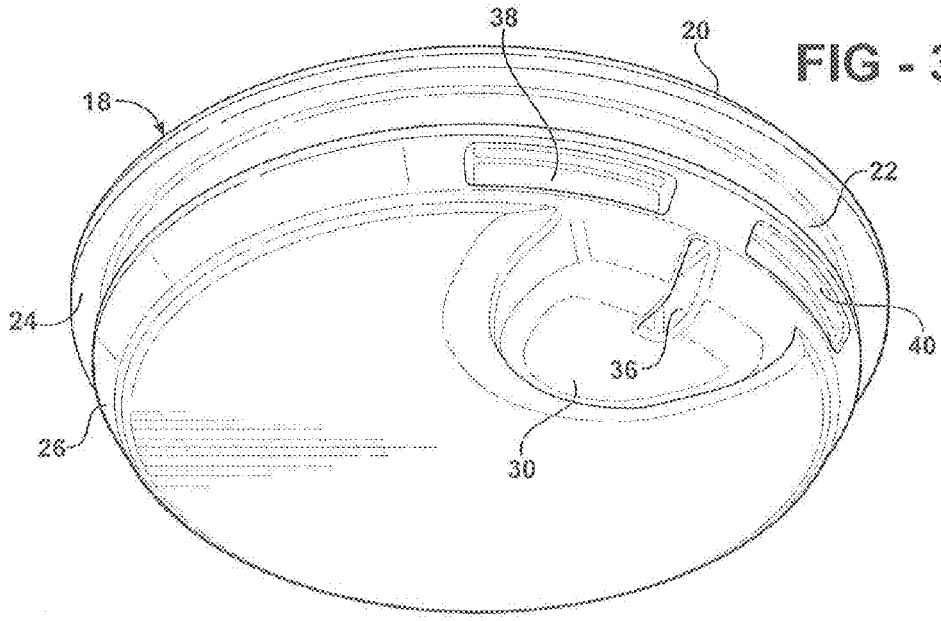
FIG. 3 is a perspective view of the tint plug of FIG. 2 from a vantage point which illustrates the bottom of the tint plug and well as well as the peripheral grove and the deformability enhancing slots.

Referring to FIG. 1 there is shown a plastic paint container 10 comprising the combination of a cylindrical plastic pail having a wire bail 13 and a snap on plastic closure 14 having a circular central deck 16 in which a tint plug 18 is installed. The physical configuration of the can 12 and enclosure 14 as well as the operative relationship between the two of them may take many forms, the form shown in FIGS. 1 and 4 being illustrative of a closure which provides a secure snap on, lock on fit with the pail 12. The pail 12 and closure 14 are typically made of high density polyethylene in an injection molding process and may be made available in various sizes. The can 12 shown in FIGS. 1 and 4 is representative of a one gallon container.

Figure 4:
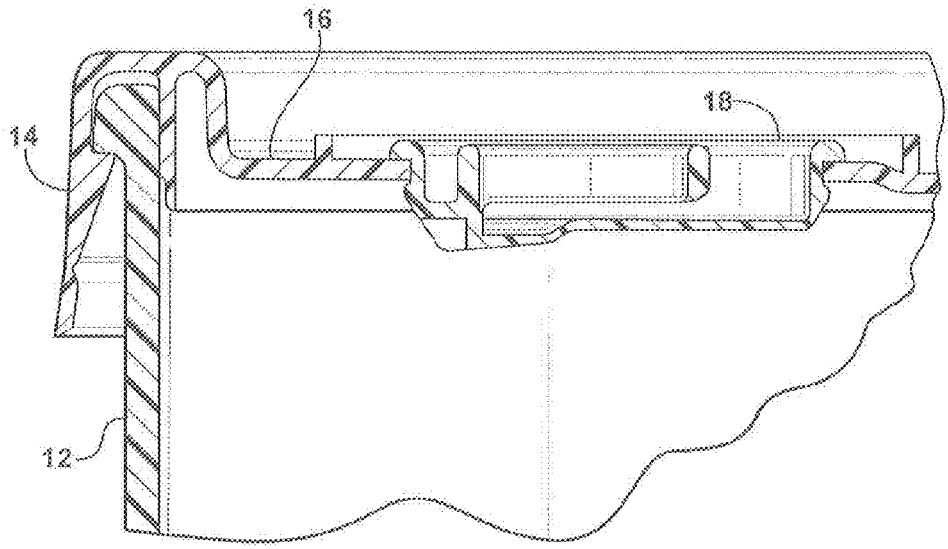
FIG. 4 is a sectional view of the container of FIG. 1 showing the relationship between the installed tint plug and the closure deck.
Figure 5:
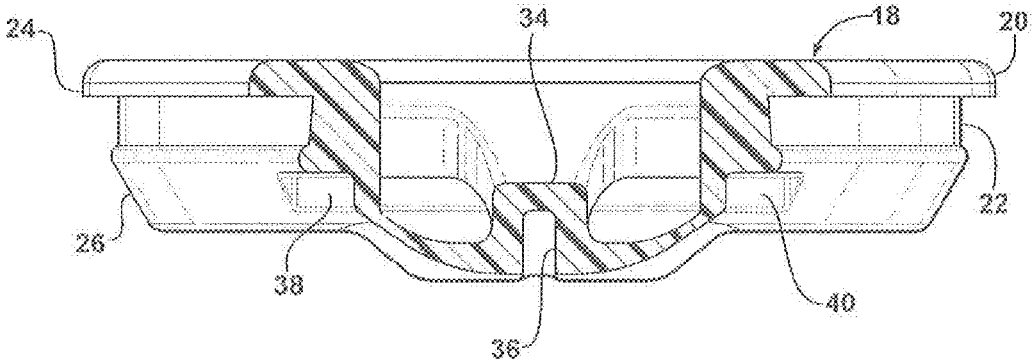
FIG. 5 is a side view of the tint plug of FIGS. 1, 2 and 3 partly in cross-section to illustrate the manner in which the pull ring stem is attached to the well portion of the tint plug deck.

Referring now to FIGS. 2-5, the tint plug 18 is shown to comprise an annular rim structure 20 defining an external peripheral groove 22 which is dimensioned to fit snugly within an aperture in the closure deck 16 as best shown in FIG. 4 when the tint plug 18 is properly installed.. The rim structure comprises an upper annular rim 24 which overlies the deck 16 in the installed position and a tapered lower rim structure 26 which acts as a guide when the plug 18 is installed within the aperture in the closure deck 16 and underlies the deck in the installed condition. The plug 18 has a recessed circular deck 28, a portion of which immediately adjacent the inner surface of the rim structure 20 is recessed to form a well 30, the material thickness of which is slightly less than the relatively uniform material thickness of the remainder of the deck 28. This reduced thickness makes the area of the well 30 and the adjacent rim more pliable and more easily deformed than the remainder of the deck 28 and rim. A pull ring 32 which is smaller in diameter than the rim structure 20 fits within the recess immediately above the deck 28 and has an integral stem which is attached to the material of the well immediately adjacent the rim structure 20. This attachment lowers the pull point of the ring 32 relative to the rim structure 20. This attachment lowers the pull point of the ring 32 relative to the rim structure 20. The stem 34 is bifurcated by a slot 36, the function of which is to eliminate excess plastic material from the plug 18 and allow the thicker areas of the plug to solidify faster after the molding operation. Additional circumferential slots 38 and 40 are formed in the exterior surface of the tapered lower rim structure 26 in opposite symmetrical, i.e., mirror image relationship to the slot 36 to further enhance the locally deformable nature of the plug 18 in the area of the well where the pull ring 32 is attached.

In operation the user grasps the pull ring 32 and pulls it up and away from the container 10. The rim adjacent the well area 30, is more deformable than the balance of the plug by the reduced thickness of the well 30 and the presence of the slots 38 and 40 and tends to separate from the closure deck 16 first. This breaks the seal between the plug 18 and the closure deck 16 and allows the plug to "peel" progressively back away from the closure deck 16 rather than popping out in an abrupt manner.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A tint plug for paint containers of the type comprising a container and a closure to be attached to the container, wherein the tint plug comprises the integral and unitary plastic combination of:

a deformable annular rim structure adapted to sealingly fit within the edge of an aperture in the closure;

a recessed deck formed interiorly of the rim structure and integral therewith and having an area defined essentially by the inner diameter of the rim structure;

a recessed well formed integrally within the deck and being more deformable than the deck, said well being offset from the center of the deck so as to be immediately adjacent the rim structure and having an area which is substantially less than the area of the deck;

a pull ring of a diameter which allows the ring to fit within the area of the well but which is too large to fit within the well, the ring having stem which projects into and is integrally attached to the well immediately adjacent the rim structure such that when force is applied to the tint plug by way of the ring, the well and the rim structure immediately adjacent the well deform and lose seal with the edge of the closure aperture.

2. The tint plug defined in claim 1 further including a partial circumferential slot formed man exterior surface of the rim structure proximate the well.

3. The tint plug defined in claim 1 further including a pair of partial circumferential slots formed in an exterior surface of the rim structure in opposed symmetrical relationship to the pull ring stem.

4. A tint plug as defined in claim 1 wherein the rim structure comprises an upper rim structure above the groove and a tapered lower rim structure below the groove.

5. In combination:

a plastic closure for a plastic paint can and having an upper deck with an aperture formed within the deck portion; and a plastic tint plug releasably disposed within the aperture of the closure deck and comprising the unitary plastic combination of a deformable annular rim structure adapted to sealingly fit within the edge of an aperture in the closure;

a recessed deck formed interiorly of the rim structure and integral therewith, having a first material thickness and an area defined essentially by the inner diameter of the rim structure;

a recessed well formed integrally within the deck and having a second material thickness less than the material thickness of the deck so as to be more deformable than the deck, said well being offset from the center of the deck so as to be immediately adjacent the rim structure and having an area which is substantially less than the area of the deck;

a pull ring of a diameter which allows the ring to fit within the rim structure but which is too large to fit entirely within the well, the ring having a stem which projects into and is integrally attached to the well immediately adjacent the rim structure such that when force is applied to the tint plug by way of the ring, the well and the rim structure immediately adjacent the well deform and lose seal with the edge of the closure aperture.

6. The tint plug defined in claim 5 further including a partial circumferential slot formed in an exterior surface of the rim structure proximate the well.

7. The tint plug defined in claim 5 further including a pair of partial circumferential slots formed in an exterior surface of the rim structure in opposed symmetrical relationship to the pull ring stem.

8. A tint plug as defined in claim 5 wherein the rim structure comprises an upper rim structure above the groove and a tapered lower rim structure below the groove.

* * * * *